US009811028B2

(12) United States Patent
Oura et al.

(10) Patent No.: US 9,811,028 B2
(45) Date of Patent: Nov. 7, 2017

(54) IMAGE FORMING APPARATUS, IMAGE FORMING SYSTEM AND IMAGE FORMING METHOD

(71) Applicant: Konica Minolta, Inc., Tokyo (JP)

(72) Inventors: Keisuke Oura, Hino (JP); Erika Sawada, Ebina (JP); Shigetaka Kurosu, Hino (JP); Yoshitada Karimai, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/346,895

(22) Filed: Nov. 9, 2016

(65) Prior Publication Data

US 2017/0160680 A1 Jun. 8, 2017

(30) Foreign Application Priority Data

Dec. 3, 2015 (JP) ..... 2015-236202

(51) Int. Cl.
*G03G 15/16* (2006.01)

(52) U.S. Cl.
CPC ..... *G03G 15/1615* (2013.01); *G03G 15/1675* (2013.01)

(58) Field of Classification Search
CPC ..... G03G 15/1615; G03G 15/1675
USPC ..... 399/66
See application file for complete search history.

(56) References Cited

U.S. PATENT DOCUMENTS 7,643,767 B2 * 1/2010 Seto ..... G03G 15/167 399/302
2014/0241744 A1 * 8/2014 Ichikawa ..... G03G 15/1615 399/66

FOREIGN PATENT DOCUMENTS

JP 2010026189 A 2/2010
JP 2014089389 A 5/2014

* cited by examiner

*Primary Examiner* — Hoang Ngo
(74) *Attorney, Agent, or Firm* — Lucas & Mercanti, LLP

(57) ABSTRACT

An image forming apparatus in which tension is applied to a recording medium during secondary transferring includes an image carrier, a first rotating member, a second rotating member, a tension releasing device, a voltage applier, a voltage measuring device, a nip width adjuster and a controller. The second rotating member sandwiches the image carrier with the first rotating member to from a nip. The tension releasing device releases the tension. The voltage measuring device measures the voltage between the first rotating member and the second rotating member applied by the voltage applier. The nip width adjuster adjusts a width of the nip. The controller controls the nip width adjuster so that a difference between a first voltage which is measured in a state where the tension is released and a second voltage which is measured in a state where the tension is applied within a predetermined range.

17 Claims, 7 Drawing Sheets

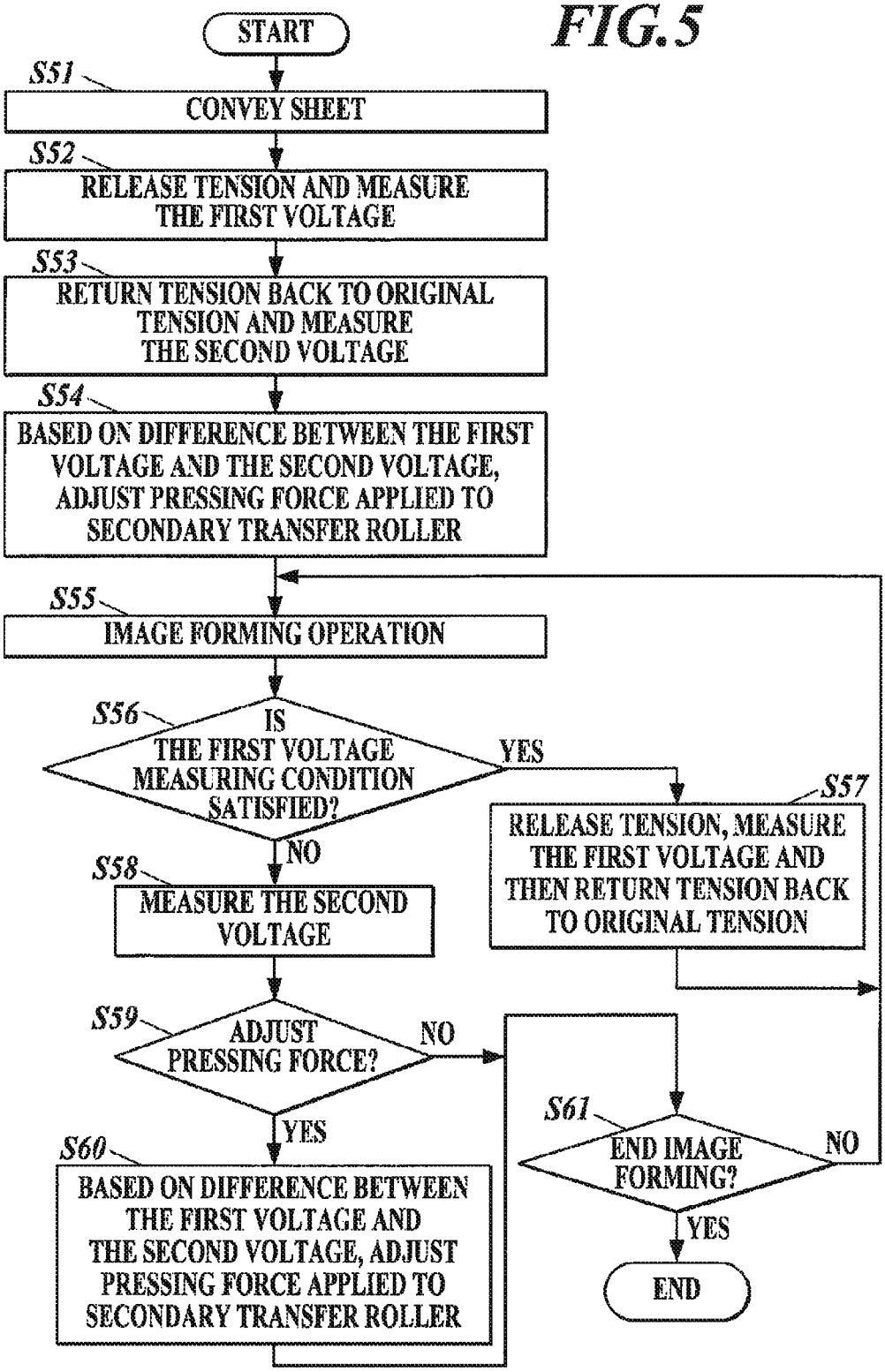
FIG.5
START
S51
CONVEY SHEET
S52
RELEASE TENSION AND MEASURE THE FIRST VOLTAGE
S53
RETURN TENSION BACK TO ORIGINAL TENSION AND MEASURE THE SECOND VOLTAGE
S54
BASED ON DIFFERENCE BETWEEN THE FIRST VOLTAGE AND THE SECOND VOLTAGE, ADJUST PRESSING FORCE APPLIED TO SECONDARY TRANSFER ROLLER
S55
IMAGE FORMING OPERATION
S56
IS THE FIRST VOLTAGE MEASURING CONDITION SATISFIED?
YES
NO
S57
RELEASE TENSION, MEASURE THE FIRST VOLTAGE AND THEN RETURN TENSION BACK TO ORIGINAL TENSION
S58
MEASURE THE SECOND VOLTAGE
S59
ADJUST PRESSING FORCE?
NO
YES
S60
BASED ON DIFFERENCE BETWEEN THE FIRST VOLTAGE AND THE SECOND VOLTAGE, ADJUST PRESSING FORCE APPLIED TO SECONDARY TRANSFER ROLLER
S61
END IMAGE FORMING?
NO
YES
END

FIG. 7A

| SHEET TENSION | SHEET CONVEYANCE | TONER IMAGE | TYPE |
|---|---|---|---|
| NO | YES | NO | THE FIRST VOLTAGE |
| YES | YES | NO | THE SECOND VOLTAGE |

FIG. 7B

| SHEET TENSION | SHEET CONVEYANCE | TONER IMAGE | TYPE |
|---|---|---|---|
| NO | YES | YES | THE FIRST VOLTAGE A |
| YES | YES | YES | THE SECOND VOLTAGE A |

FIG. 7C

| SHEET TENSION | SHEET CONVEYANCE | TONER IMAGE | TYPE |
|---|---|---|---|
| NO | NO | NO | THE FIRST VOLTAGE B |
| YES | NO | NO | THE SECOND VOLTAGE B |

IMAGE FORMING APPARATUS, IMAGE FORMING SYSTEM AND IMAGE FORMING METHOD

CROSS REFERENCE TO RELATED APPLICATION

This Application claims priority of Japanese Patent Application No. 2015-236202 filed on Dec. 3, 2015, application which is incorporated herein by reference.

BACKGROUND OF THE INVENTION

1. Field of the Invention

The present invention relates to an image forming apparatus, an image forming system and an image forming method.

2. Description of Related Art

Traditionally, in an image forming apparatus which forms images while conveying a recording medium using the R2R (roll to roll) method, a continuous sheet which is the recording medium receives tension when it is being conveyed. Since the transfer device in the image forming apparatus is structured so as to sandwich an intermediate transfer belt between a secondary transfer roller and a roller facing the secondary transfer roller, the secondary transfer roller is pushed downward due to the tension applied to the continuous sheet and this may lead to the width of the secondary transfer nip which is formed by the secondary transfer roller and the roller facing the secondary transfer roller be small.

If a large pressure is applied to the secondary transfer roller to press the secondary transfer roller against the roller facing the secondary transfer roller in resistance to the tension applied to the continuous sheet, noises such as voids may occur leading to degradation in the image quality. Further, since the tension applied to the continuous sheet varies according to conditions such as glue adhesion, static and the like in the conveyance path, the width of the secondary transfer nip also varies every time the tension applied to the continuous sheet varies leading to unstable secondary transferring.

There is known a transfer device in which, in order to prevent the width of the secondary transfer nip from varying, a sheet sensor detects sheet thickness in the sheet conveyance path and a determining unit determines whether to adjust the pressing force applied to the secondary transfer roller according to the detection result obtained by the sheet sensor. By using such transfer device, the image quality can be stable even if the thicknesses of the sheets which pass through the secondary transfer nip vary (see JP 2014-089389).

Further, there is known an image forming apparatus including a detector which measures the electric resistance of a primary transfer roller and adjusts the width of the nip which is formed between the primary transfer roller and the corresponding photoreceptor drum according to the electric resistance of the primary transfer roller which is measured by the detector so that the electric resistance value of the primary transfer roller be constant at any time. In such image forming apparatus, the image quality can be prevented from being degraded due to the electric resistance of the transfer roller varying according to environmental changes and changes over time (see JP 2010-026189).

Although the device and the apparatus of JP 2014-089389 and JP 2010-026189 adjusts the nip width according to the sheet thickness and the electric resistance of the transfer roller, they are not used in the image forming where images are formed on a recording medium which is conveyed using the R2R (roll to roll) method. Therefore, there is a problem that the width at the secondary transfer nip cannot be corrected in the case where tension is applied to the continuous sheet during the secondary transferring.

SUMMARY OF THE INVENTION

The present invention is made in view of the above problem and an object of the present invention is to provide an image forming apparatus, an image forming system and an image forming method which can control the varying of the width of the secondary transfer nip and improve the image quality even in the case where tension is applied to the continuous sheet during the secondary transferring.

To solve at least one of the objects described above, in accordance with one aspect of the present invention, there is provided an image forming apparatus in which tension is applied to a recording medium during secondary transferring, including:

an image carrier;

a first rotating member which comes in contact with the image carrier;

a second rotating member which sandwiches the image carrier with the first rotating member to from a nip;

a tension releasing device which releases the tension;

a voltage applier which applies a voltage between the first rotating member and the second rotating member at a predetermined constant current;

a voltage measuring device which measures the voltage applied by the voltage applier;

a nip width adjuster which adjusts a width of the nip; and a controller which controls the nip width adjuster so that a difference between a first voltage which is measured in a state where the tension releasing device is controlled to release the tension applied to the recording medium and a second voltage which is measured in a state where the tension is applied to the recording medium be within a predetermined range, the first voltage and the second voltage being measured by the voltage measuring device.

Preferably, in the image forming apparatus, in a case where the second voltage is greater than the first voltage, the controller controls the nip width adjuster so as to make the width of the nip be wider.

Preferably, in the image forming apparatus, the controller makes the nip width adjuster adjust the width of the nip on a basis of the first voltage and the second voltage which are measured before carrying out the secondary transferring.

Preferably, in the image forming apparatus, the controller makes the nip width adjuster adjust the width of the nip on a basis of the first voltage and the second voltage which are measured at a predetermined timing during the secondary transferring.

Preferably, in the image forming apparatus, the voltage measuring device repeatedly measures the first voltage and the second voltage, and the controller makes the nip width adjuster adjust the width of the nip continuously every time the first voltage and the second voltage are measured by the voltage measuring device.

Preferably, in the image forming apparatus, the first voltage and the second voltage are voltages in a case where a toner image is not formed on the image carrier.

To solve at least one of the objects described above, in accordance with one aspect of the present invention, there is provided An image forming apparatus in which tension is applied to a recording medium during secondary transferring, including:

an image carrier;

a first rotating member which comes in contact with the image carrier;

a second rotating member which sandwiches the image carrier with the first rotating member to form a nip;

a tension releasing device which releases the tension;

a current supplier which applies a current between the first rotating member and the second rotating member at a predetermined constant voltage;

a current measuring device which measures the current supplied by the current supplier;

a nip width adjuster which adjusts a width of the nip; and a controller which controls the nip width adjuster so that a difference between a first current which is measured in a state where the tension releasing device is controlled to release the tension applied to the recording medium and a second current which is measured in a state where the tension is applied to the recording medium be within a predetermined range, the first current and the second current being measured by the current measuring device.

Preferably, in the image forming apparatus, the controller makes the nip width adjuster adjust the width of the nip on a basis of the first current and the second current which are measured before carrying out the secondary transferring.

Preferably, in the image forming apparatus, the controller makes the nip width adjuster adjust the width of the nip on a basis of the first current and the second current which are measured at a predetermined timing during the secondary transferring.

Preferably, in the image forming apparatus, the current measuring device repeatedly measures the first current and the second current, and the controller makes the nip width adjuster adjust the width of the nip continuously every time the first current and the second current are measured by the current measuring device.

Preferably, in the image forming apparatus, the first current and the second current are currents in a case where a toner image is not formed on the image carrier.

Preferably, in the image forming apparatus, the nip width adjuster adjusts a pressing force applied to the second rotating member.

Preferably, in the image forming apparatus, the tension releasing device releases the tension by increasing a conveying speed of the recording medium before the secondary transferring.

Preferably, in the image forming apparatus, the tension releasing device includes a stretching device which extends the recording medium in a predetermined direction, and the tension releasing device moves the stretching device in a direction that allows to release the recording medium when the conveying speed of the recording medium is to be increased.

To solve at least one of the objects described above, in accordance with one aspect of the present invention, there is provided an image forming system, including:

the image forming apparatus described above;

a sheet feeding apparatus in which a roll of the recording medium is housed and which feeds the recording medium to the image forming apparatus; and a roll-up apparatus which rolls up the recording medium on which an image is formed by the image forming apparatus in a roll form.

To solve at least one of the objects described above, in accordance with one aspect of the present invention, there is provided An image forming method in which tension is applied to a recording medium during secondary transferring, including:

first measuring a first voltage or a first current in a state where the tension is released;

second measuring a second voltage or a second current in a state where the tension is applied; and adjusting a width of a nip so that a difference between the first voltage and the second voltage or a difference between the first current and the second current be within a predetermined range, the nip being formed by two rotating members sandwiching an image carrier.

BRIEF DESCRIPTION OF THE DRAWINGS

The present invention will become more fully understood from the detailed description given hereinbelow and the appended drawings which are given byway of illustration only, and thus are not intended as a definition of the limits of the present invention, and wherein:

FIG. 5 is a flowchart showing an operation example of the image forming apparatus;

FIG. 7A is a chart used for describing a combination example of the first voltage (reference voltage) and the second voltage (actual voltage);

FIG. 7B is a chart used for describing a combination example of the first voltage (reference voltage) and the second voltage (actual voltage); and FIG. 7C is a chart used for describing a combination example of the first voltage (reference voltage) and the second voltage (actual voltage).

DESCRIPTION OF THE PREFERRED EMBODIMENTS

Embodiment

[1. Description of Structure]

Figure 1:
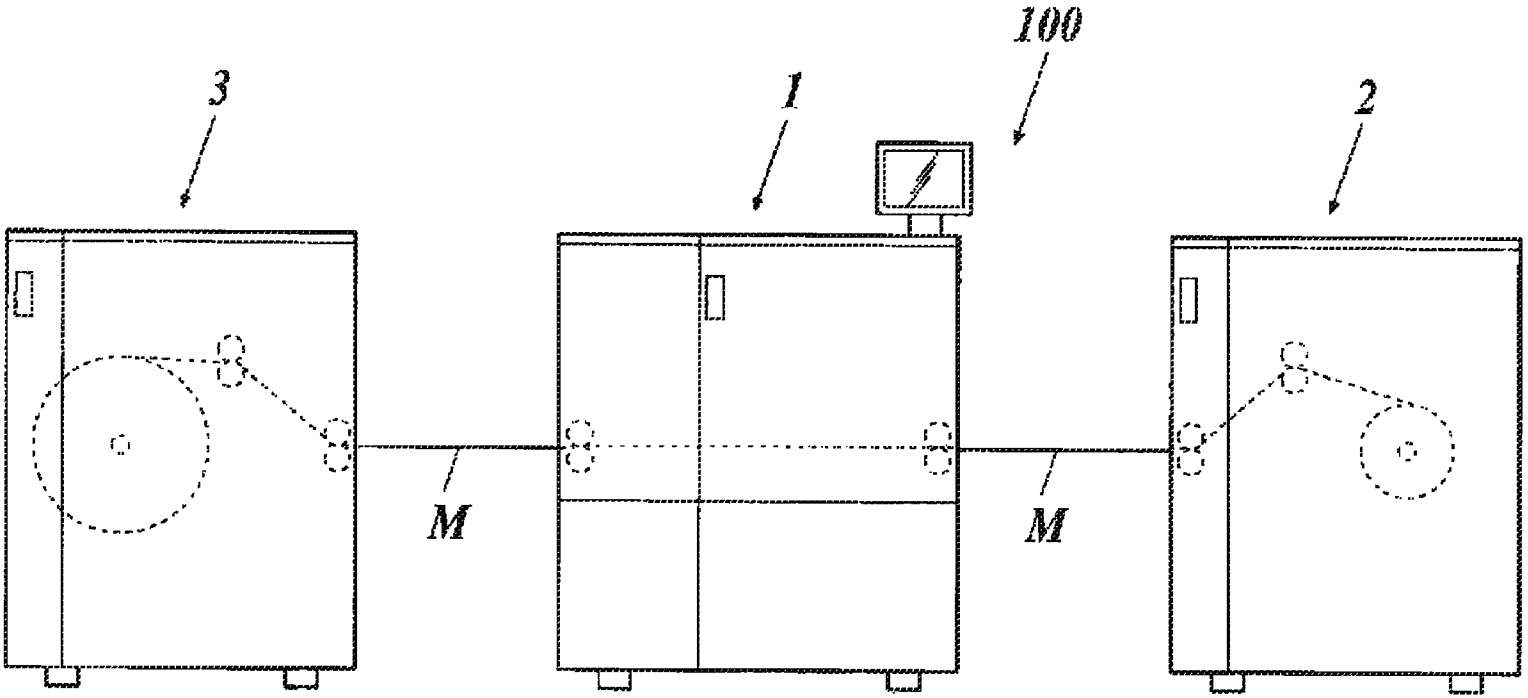
FIG. 1 is a schematic view showing the structure of an image forming system according to an embodiment to which the present invention is applied.

Hereinafter, specific aspects of the present invention will be described with reference to the drawings. However, the scope of the invention is not limited to the examples shown in the drawings.

Figure 2:
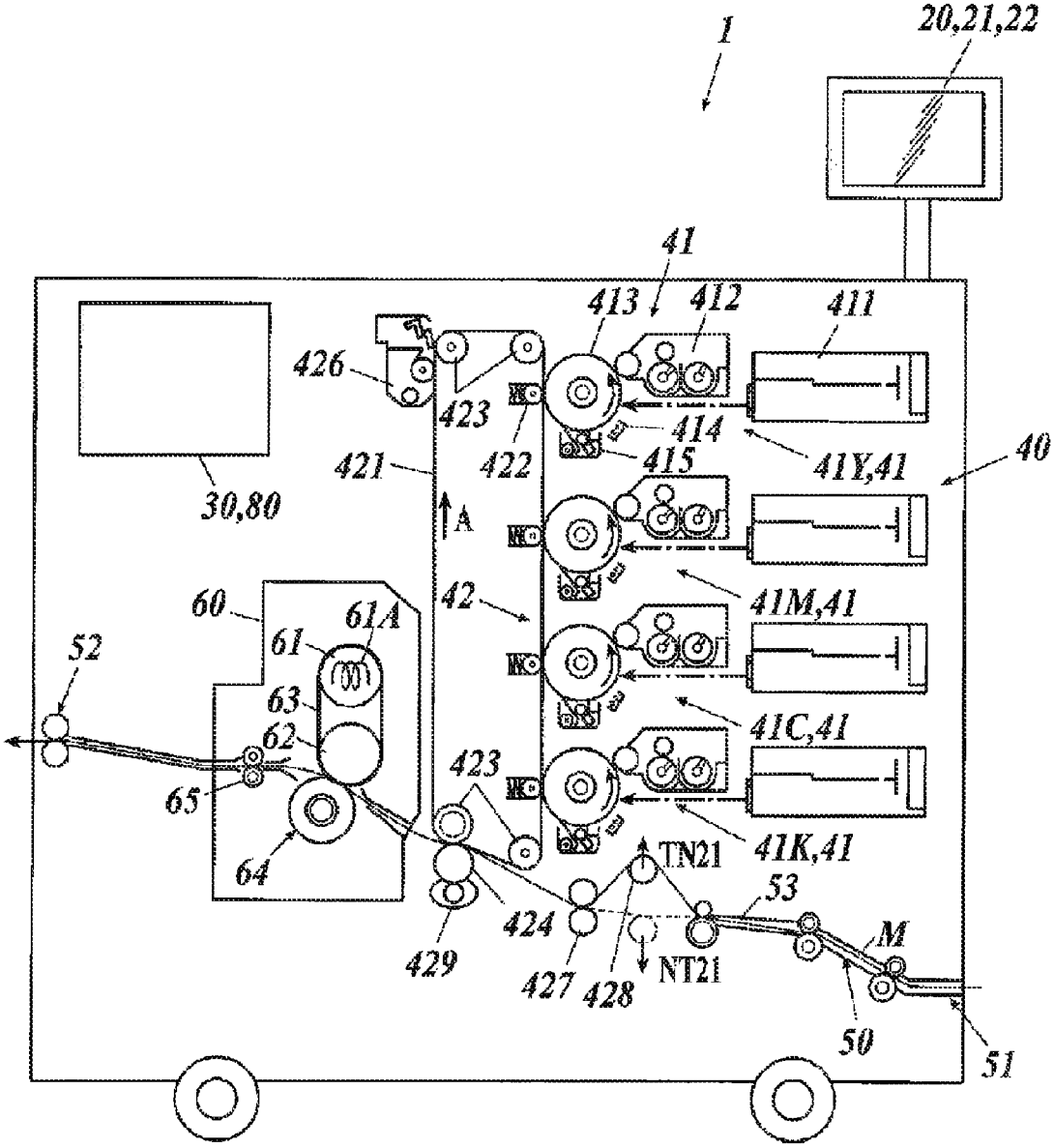
FIG. 2 is a schematic view showing the structure of an image forming apparatus according to the embodiment to which the present invention is applied.

FIG. 1 is a schematic view showing the structure of the image forming system 100 according to an embodiment to which the present invention is applied. FIG. 2 is an explanatory view of the detailed structure of the image forming apparatus 1.

The image forming system 100 includes an image forming apparatus 1, a sheet feeding apparatus 2 and a roll-up apparatus 3. The image forming system may be configured by only including the image forming apparatus 1 and without including the sheet feeding apparatus 2 and the roll-up apparatus 3.

In the sheet feeding apparatus 2, a continuous sheet M such as a rolled paper sheet, a continuous ledger sheet or the like is housed, for example, and the sheet feeding apparatus 2 feeds the continuous sheet M to the image forming apparatus 1. In the image forming apparatus 1, images are formed on the continuous sheet M which is fed from the sheet feeding apparatus 2. In the roll-up apparatus 3, the continuous sheet M which is conveyed from the image forming apparatus 1 in accordance with the instruction given by the image forming apparatus 1 is rolled up in a roll.

FIG. 2 shows a structure example of the image forming apparatus 1. The image forming apparatus 1 shown in FIG. 2 is an intermediate transfer type color image forming apparatus which uses the electrophotographic processing technique. The image forming apparatus 1 uses the vertical tandem system where photoreceptor drums 413 corresponding to four colors, Y (yellow), M (magenta), C (cyan) and K (black), are arranged in series along the running direction (perpendicular direction) of the intermediate transfer belt 421 and the toner images of the individual colors are sequentially transferred onto the intermediate transfer belt 421.

That is, in the image forming apparatus 1, the toner images of the individual colors, YMCK, which are formed on the photoreceptor drums 413 are transferred onto the intermediate transfer belt 421 (primary transferring) to superimpose the toner images of the four colors on each other on the intermediate transfer belt 421 and thereafter, the superimposed image is transferred onto the continuous sheet M (secondary transferring) to form an image.

Figure 3:
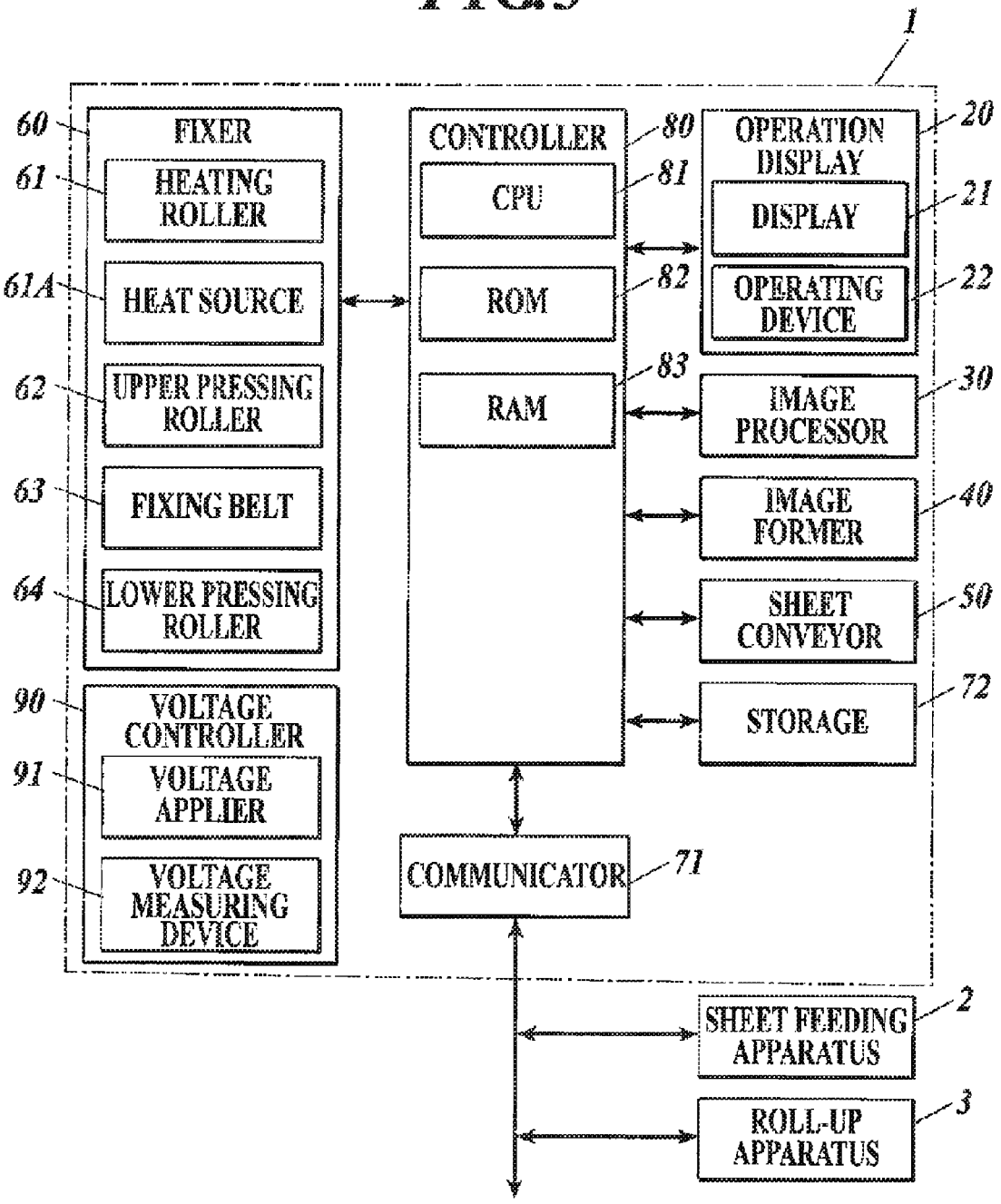
FIG. 3 is a block diagram used for describing a controlling system of the image forming apparatus.

FIG. 3 is a block diagram showing the main components of a controlling system of the image forming apparatus 1.

As shown in FIGS. 2 and 3, the image forming apparatus 1 includes an operation display 20, an image processor 30, an image former 40, a sheet conveyor 50, a fixer 60, a controller 80 and a voltage controller 90.

The controller 80 includes a CPU (Central Processing Unit) 81, a ROM (Read Only Memory) 82, a RAM (Random Access Memory) 83 and the like. The CPU 81 reads out a program corresponding to a process from the ROM 82 or the storage 72, opens the program in the RAM 83 and then, the CPU 81 controls the operation of the image forming apparatus 1, the sheet feeding apparatus 2 and the roll-up apparatus 3 in cooperation with the opened program.

The communicator 71 includes various types of interfaces such as a network card, a modem, a USB (Universal Serial Bus) and the like, for example. The storage 72 is configured by including a non-volatile semiconductor memory (so-called flash memory), a hard disk drive and the like, for example. In the storage 72, a look-up table which is referred to when the operation of each block is to be controlled is stored, for example.

The controller 80 carries out sending and receiving of various types of data with an external device (for example, a personal computer) which is connected to a communication network such as a LAN (Local Area Network), a WAN (Wide Area Network) and the like via the communicator 71. The controller 80 receives image data (input image data) of page description language (PDL) which is sent from the external device, for example, and forms an image on the continuous paper M on the basis of the received image data. The controller 80 carries out sending and receiving of various types of data with the sheet feeding apparatus 2 and the roll-up apparatus 3 via the communicator 71.

The voltage controller 90 includes a voltage applier 91 which applies the secondary transferring voltage and a voltage measuring device 92 which measures the value of the applied secondary transferring voltage. The voltage controller 90 carries out the so-called constant current controlling where the secondary transferring voltage at a predetermined constant current.

The operation display 20 is configured by including a liquid crystal display (LCD) with touch panel, for example, and functions as a display 21 and an operating device 22.

The display 21 displays various types of operation screens, operation conditions of various functions and the like in accordance with display control signals which are input from the controller 80. The display 21 further receives touch operation performed by a user and outputs operation signals relating to the touch operation to the controller 80.

The operating device 22 includes various types of operating keys such as a numeric keypad, a star key and the like. The operating device 22 receives various types of input operations performed by a user and outputs operation signals relating to the input operations to the controller 80. A user can operate on the operation display 20 to carry out settings relating to image forming such as image quality setting, scale factor setting, application setting, output setting, paper setting and the like and to give an instruction to convey the sheet.

The image processor 30 includes a circuit and the like which carries out a digital image processing on input image data in accordance with the initial setting or the user setting. For example, under the controlling of the controller 80, the image processor 30 carries out the tone correction on the basis of the tone correction data (tone correction table). The image processor 30 further carries out various types of correction processes such as color correction, shading correction and the like and a compression process and the like on input image data. The image former 40 is controlled on the basis of the image data on which the above mentioned processes are carried out.

The image former 40 includes image forming units 41 and an intermediate transfer unit 42 and the like for forming an image of color toners of Y component, M component, C component and K component on the basis of input image data.

There are four image forming units 41 which are image forming units 41Y, 41M, 41C and 41K respectively for Y component, M component, C component and K component. Since the image forming units 41Y, 41M, 41C and 41K have the same configuration, they will be indicated by the same symbol hereinafter. Each image forming unit 41 includes an exposure device 411, a developing device 412, a photoreceptor drum 413, a charger 414, a drum cleaner 415 and the like.

The photoreceptor drum 413 is a negatively charged organic photoreceptor (OPC) made by sequentially layering an undercoat layer (UCL), a charge generation layer (CGL) and a charge transport layer (CTL) on the surface of an aluminum conductive cylindrical body (aluminum pipe), for example. The charge generation layer is formed of an organic semiconductor where a charge generating material (for example, phthalocyanine pigment) is dispersed in a resin binder (for example, polycarbonate) and generates a pair of positive charge and negative charge when exposed to light by the exposure device 411. The charge transport layer is formed of a material where a hole transporting material (electron donative nitrogen-containing compound) is dispersed in a resin binder and transports the positive charge generated in the charge generation layer to the surface of the charge transport layer.

The charger 414 includes a corona discharge generator such as a scorotron charger, a corotron charger or the like, for example. The charger 414 equally charges the surface of the photoreceptive drums 413 so as to be negatively charged by corona discharge.

The exposure device 411 includes a LED print head including a LED array where a plurality of light emitting diodes (LEDs) are arranged in a straight line, a LPH driver (driver IC) for driving the individual LEDs, a lens array for forming an image on a photoreceptor drum 413 with the light emitted from the LED array and the like. One LED in the LED array corresponds to one dot in an image. The controller 80 controls the LPH driver to apply a predetermined driving current to the LED array and a specified LED emits light.

The exposure device 411 emits the light according to the image of the corresponding color component to its corresponding photoreceptive drum 413. By the positive charge generated in the charge generation layer of the photoreceptive drum 413 being transported to the surface of the charge transport layer, the surface charge (negative charge) of the photoreceptive drum 413 is neutralized. In such way, on the surface of the photoreceptive drum 413, an electrostatic image of the corresponding color component is formed due to the difference in potential comparing to the surrounding.

The developing device 412 houses the developer (for example, a two component developer formed of toner and magnetic carrier) for the corresponding color component. The developing device 412 visualizes the electrostatic image by attaching the toner of the corresponding color component on the surface of the photoreceptive drum 413 and forms a toner image. In particular, a developing bias voltage is applied to the developer carrier (developing roller) and the charged toner on the developer carrier moves to and attaches to the exposed section on the surface of the photoreceptive drum 413 due to the difference in potential between the photoreceptive drum 413 and the developer carrier.

The drum cleaner 415 includes a drum cleaning blade or the like which slides on the surface of the photoreceptive drum 413 and removes the residual toner that remains on the surface of the photoreceptor drum 413 after the primary transferring.

The intermediate transfer unit 42 includes the intermediate transfer belt 421, primary transfer rollers 422, a plurality of supporting rollers 423, a secondary transfer roller 424, a belt cleaner 426 and the like.

The intermediate transfer belt 421 is an endless belt and is stretched in a loop around the plurality of supporting rollers 423. At least one of the plurality of supporting rollers 423 is the driving roller and the other supporting rollers are the driven rollers. For example, it is preferred that the supporting roller 423 which is located more on the downstream side in the belt running direction comparing to the primary transfer roller 422 of K component is the driving roller. The driving roller rotates to make the intermediate transfer belt 421 run in the direction indicated by the arrow A at a constant speed.

Each of the primary transfer rollers 422 faces the corresponding photoreceptive drum 413 of the corresponding color component. The individual primary transfer rollers 422 are disposed on the inner surface side of the intermediate transfer belt 421. The primary transfer rollers 422 are pressed against their corresponding photoreceptive drums 413 sandwiching the intermediate transfer belt 421 therebetween to form the primary transfer nips for transferring the toner images from the photoreceptive drums 413 to the intermediate transfer belt 421.

The secondary transfer roller 424 faces at least one of the plurality of supporting rollers 423 and is located on the outer surface side of the intermediate transfer belt 421. The supporting roller which is located so as to face the intermediate transfer belt 421 is called the back-up roller. The secondary transfer roller 424 is pressed against the back-up roller sandwiching the intermediate belt 421 therebetween to form a secondary transfer nip N (hereinafter, simply called the nip N) for transferring the toner image (superimposed toner image) from the intermediate transfer belt 421 to the continuous sheet M.

When the intermediate transfer belt 421 passes through the primary transfer nips, the toner images on the individual photoreceptive drums 413 are sequentially transferred onto the intermediate transfer belt 421 so as to be superimposed on each other (primary transferring). In particular, the primary transfer bias is applied to the primary transfer rollers 422 and the charge having a polarity that is opposite to the polarity of the toner is applied to the back side of the intermediate transfer belt 421 (on the side which comes in contact with the primary transfer rollers 422) to electrostatically transfer the toner images onto the intermediate transfer belt 421.

Thereafter, when the continuous sheet M passes through the nip N, the toner image (superimposed toner image) on the intermediate transfer belt 421 is transferred onto the continuous sheet M (secondary transferring). In particular, the secondary transfer bias (transferring voltage) is applied between the secondary transfer roller 424 and the supporting roller 423 facing the secondary transfer roller 424 by the voltage applier 91 at a predetermined constant current and the charge having the polarity that is opposite to the polarity of the toner is applied to the back surface side of the continuous sheet M (the side which comes in contact with the secondary transfer roller 424) to electrostatically transfer the superimposed tonner image onto the continuous sheet M. The continuous sheet M on which the toner image (superimposed toner image) is transferred is conveyed toward the fixer 60. Further, the value of the applied secondary transferring bias (transferring voltage) is measured by the voltage measuring device 92 and the measured value is input to the controller 80.

The belt cleaner 426 includes a belt cleaning blade or the like which slides on the surface of the intermediate transfer belt 421 and removes the residual toner which remains on the surface of the intermediate transfer belt 421 after the secondary transferring.

As the tension releasing device, a driving roller 427 is controlled by the controller 80 so as to rotate at a driving speed which is faster than a normal conveying speed to loosen the portion of the continuous sheet M on the downstream side of the driving roller 427 in the conveyance direction. Thereby, the tension applied to the continuous sheet M is temporarily released.

The stretching roller 428 (stretching device) extends the continuous sheet M which is being conveyed in a predetermined direction in the normal operation and when the conveying speed of the driving roller 427 is to be increased, the stretching roller 428 moves in the direction that allows to release the continuous sheet M which is being conveyed so as to reduce the load applied to the continuous sheet M.

Figure 4A:
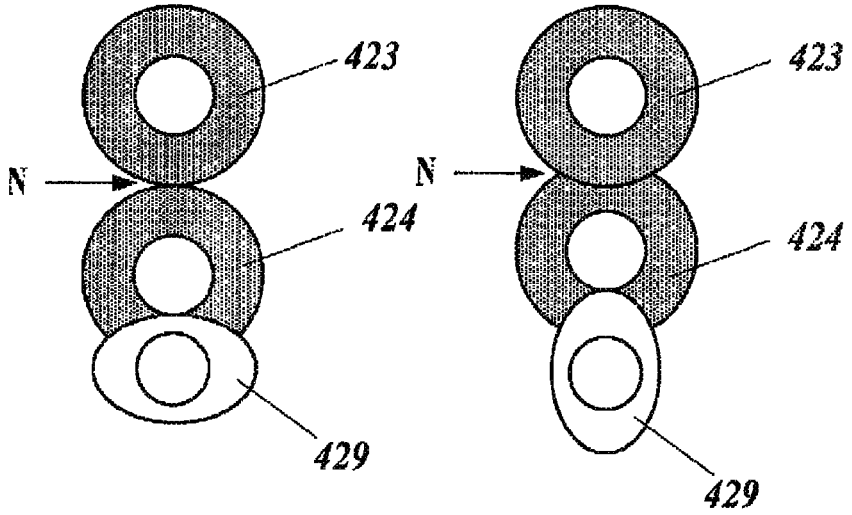
FIG. 4A is a view used for describing a specific example of a nip width adjustor.

The nip width adjuster 429 is for changing the pressing force applied to the secondary transfer roller 424. For example, the nip width adjuster 429 is a cam or the like as shown in FIG. 4A, and by adjusting the pressing force applied to the secondary transfer roller 424, the width of the nip N which is formed by the secondary transfer roller 424 and the supporting roller 423 is adjusted.

Figure 4B:
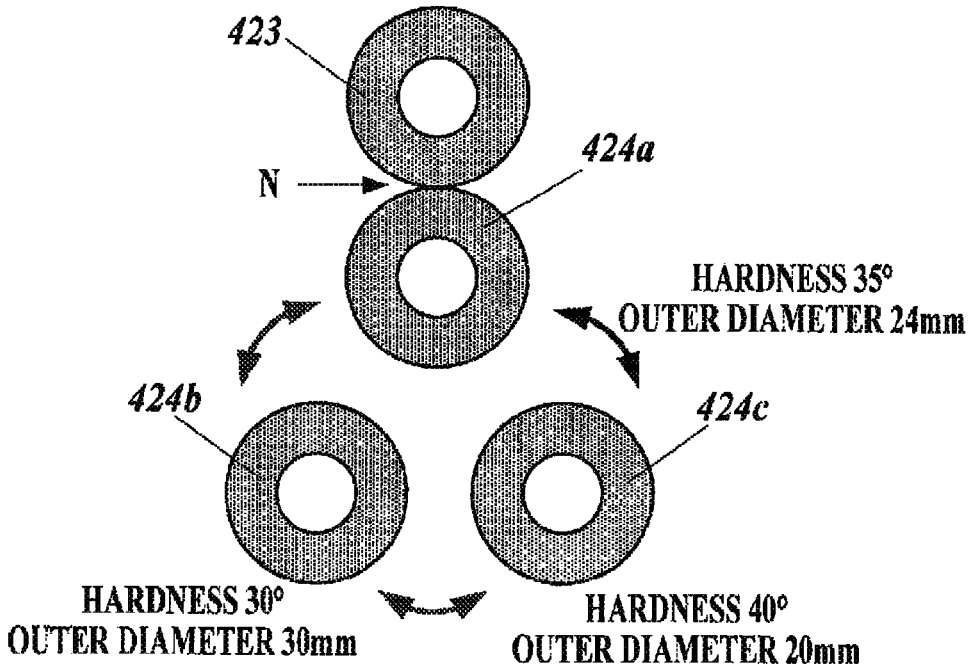
FIG. 4B is a view used for describing a specific example of a nip width adjustor.

With respect to the nip width adjuster 429, as shown in FIG. 4B, a plurality of secondary transfer rollers such as the secondary transfer rollers 424*a*, 424*b* and 424*c* having different hardness (35°, 30° and 40°) and external diameters (24 mm, 30 mm and 20 mm) may be provided, and one of the above secondary transfer rollers 424*a* to 424*c* can be selected arbitrarily and made to come in contact with the supporting roller 423 to adjust the pressing force applied to the secondary transfer roller 424 and to adjust the width of the nip N.

Further, in the intermediate transfer unit 42, instead of providing the secondary transfer roller 424, one of the plurality of supporting rollers may act as the secondary transfer roller and the secondary transfer belt may be stretched in a loop around the plurality of supporting rollers (belt type secondary transfer unit).

The sheet conveyor 50 includes a sheet feeder 51, a sheet output device 52, a sheet passing path 53 and the like. The sheet feeder 51 guides the continuous sheet M which is conveyed from the sheet feeding apparatus 2 to the sheet passing path 53. The sheet passing path 53 includes a plurality of conveyance rollers including an intermediate conveyance roller and the like. The sheet passing path 53 conveys the continuous sheet M which is fed from the sheet feeder 51 through the image former 40 (secondary transferring unit), the fixer 60 and the sheet output device 52 in this order. The sheet output device 52 guides the continuous sheet M which is conveyed from the sheet passing path 53 to the roll-up apparatus 3.

The fixer 60 includes a heating roller 61, a heat source 61A which heats the heating roller 61, an upper pressing roller 62, an endless fixing belt 63 which is looped around the heating roller 61 and the upper pressing roller 62, a lower pressing roller 64 and the like.

The heat source 61A is disposed inside or near the heating roller 61. The controller 80 controls the output of the heat source 61A to heat the heating roller 61. By rotating the fixing belt 63, the heat of the heating roller 61 is transferred to the entire fixing belt 63. The such heating preparation for fixing is carried out in a state where the fixing belt 63 is separated from the lower pressing roller 64.

By the fixing belt 63 being in the state where it is pressed against the lower pressing roller 64, a nip where the continuous sheet M is sandwiched therebetween and conveyed is formed. The continuous sheet M is heated and pressured when passing through the nip and the toner image (superimposed toner image) is fixed thereon.

[2. Description on Operation of Image Forming Apparatus 1]

The operation of the image forming apparatus 1 will be described by using the flowchart shown in FIG. 5.

The controller 80 controls the sheet conveyor 50 to convey the continuous sheet M (set S51). It is needless to say that at this time the controller 80 can also control the sheet feeding apparatus 2 and the roll-up apparatus 3 to feed the continuous sheet M from the sheet feeding apparatus 2 and to make the roll-up apparatus 3 roll up the continuous sheet M which is output from image forming apparatus 1.

Before starting the secondary transferring, the controller 80 makes the driving roller 427 which is the tension releasing device rotate at a driving speed which is faster than the normal conveying speed to temporarily release the tension applied to the continuous sheet M. At the same time, the controller 80 measures the secondary transferring voltage as the first voltage (reference voltage) (step S52) and makes the driving roller 427 rotate at the normal conveying speed to return the tension back to the original tension. In this state, the controller 80 measures the secondary transferring voltage as the second voltage (actual voltage) (step S53).

Thereafter, the controller 80 controls the nip width adjuster 429 to adjust the pressing force applied to the secondary transfer roller 424 in order to adjust the nip width so that the difference between the second voltage and the first voltage be within a predetermined range, for example, within 100V, (step S54).

Figure 6:
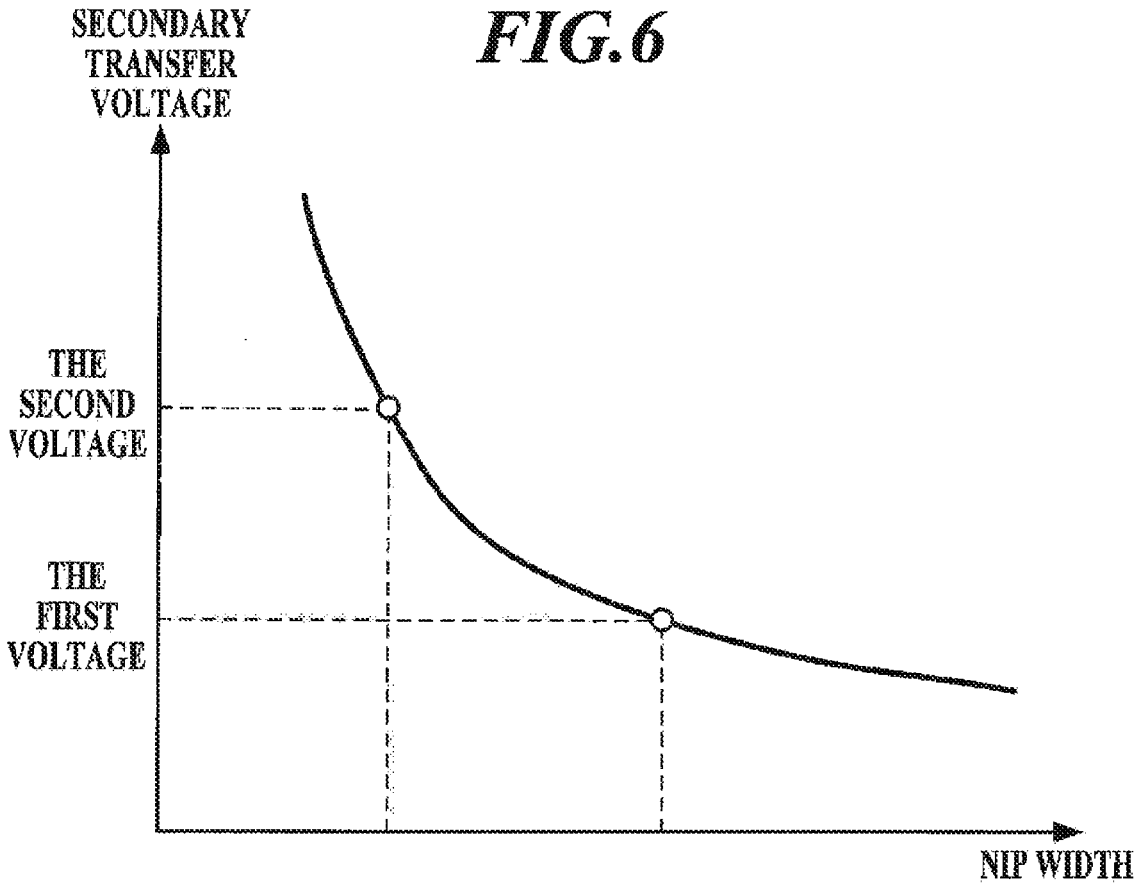
FIG. 6 is the characteristic curve showing the relation between the secondary transferring voltage and the nip width.

The first voltage and the second voltage which are measured in steps S52 and S53 are in the relation as shown in FIG. 6. As the width of the nip N be smaller due to tension being applied to the continuous sheet M, the secondary transferring voltage increases. Therefore, the second voltage which is measured when the normal tension is applied to the continuous sheet M tends to have a higher value comparing to the first voltage which is measured in the state where the tension applied to the continuous sheet M is released.

In view of the above, the controller 80 controls the nip width adjuster 429 to adjust the pressing force applied to the secondary transfer roller 424 in order to adjust the nip width be wider so that the difference between the second voltage and the first voltage be within a predetermined range (make the second voltage be closer to the first voltage).

For example, when the controller 80 controls the nip width adjuster 429 to adjust the pressing force applied to the secondary transfer roller 424, the correction value table in which correction values corresponding to differences are preset is stored in the storage 72 and the controller 80 adjusts the pressing force applied to the secondary transfer roller 424 by using the correction value which corresponds to the obtained difference.

With respect to the condition combinations for measuring the first voltage and the second voltage, there are three types of combinations as shown in FIGS. 7A to 7C. In FIG. 7A, the continuous sheet M is conveyed, a toner image (superimposed toner image) is not formed on the intermediate transfer belt 421 and the first voltage and the second voltage are measured on the basis of whether tension is applied. In FIG. 7B, the continuous sheet M is conveyed, a toner image (superimposed toner image) is formed on the intermediate transfer belt 421 and the first voltage and the second voltage are measured on the basis of whether tension is applied. In FIG. 7C, the continuous sheet M is not conveyed, a toner image (superimposed toner image) is not formed on the intermediate transfer belt 421 and the first voltage and the second voltage are measured on the basis of whether tension is applied.

In the three types of combinations shown in FIGS. 7A to 7C, the combination shown in FIG. 7A allows the most accurate measuring and thus, it is preferred to used this combination.

After adjusting the width of the nip N before starting the secondary transferring, the controller 80 carries out the normal image forming operation (step S55).

Thereafter, the controller 80 determines whether the measuring condition of the first voltage, for example, whether the continuous sheet M is conveyed 50*m* is satisfied (step S56). If the controller 80 determines that the measuring condition of the first voltage is satisfied (step S56: YES), the controller 80 temporarily releases the tension applied to the continuous sheet M, measures the secondary transferring voltage as the first voltage, returns the tension back to the original tension (step S57) and returns to step S55.

If the controller 80 determines that the measuring condition of the first voltage is not satisfied (step S56: NO), the controller 80 measures the secondary transferring voltage as the second voltage and determines whether to adjust the pressing force applied to the secondary transfer roller 424 (step S59). For example, if the difference between the second voltage and the first voltage is 100V or greater, the controller 80 determines to adjust the pressing force applied to the secondary transfer roller 424.

If the controller 80 determines not to adjust the pressing force of the secondary transfer roller 424 (step S59: NO), the controller 80 proceeds to step S61. If the controller 80 determines to adjust the pressing force of the secondary transfer roller 424 (step S59: YES), the controller 80 controls the nip width adjuster 429 to adjust the pressing force applied to the secondary transfer roller 424 in order to adjust the nip width so that the difference between the second voltage and the first voltage be within a predetermined range (step S60).

Finally, the controller 80 determines whether to end the image forming operation (step S61). If the controller 80 determines not to end the image forming operation (step S61: NO), the controller 80 returns to step S55. If the controller 80 determined to end the image forming operation (step S61: YES), the controller 80 ends the process.

As described above, the image forming apparatus 1 of the embodiment includes the intermediate transfer belt 421, the supporting rollers 423 which come in contact with the intermediate transfer belt 421, the secondary transfer roller 424 which sandwiches the intermediate transfer belt 421 with one of the supporting rollers 423 forming the nip N, the tension releasing device 427 which releases the tension, the voltage applier 91 which applies the transferring voltage between one of the supporting rollers 423 and the secondary transfer roller 424 at a predetermined constant current, the voltage measuring device 92 which measures the transferring voltage, the nip width adjuster 429 which adjusts the width of the nip N and the controller 80 which controls the nip width adjuster 429 to adjust the nip width so that the difference between the second voltage and the first voltage be within a predetermined range, the second voltage being measured by the voltage measuring device 92 and the first voltage being measured in the state where the tension releasing device 427 is controlled to release the tension. Therefore, even in the case where tension is applied to the continuous sheet during the secondary transferring, varying of the width of the nip N can be controlled and the image quality can be improved.

(Modification 1)

In the description of the embodiment, the controller 80 makes the driving roller 427 which is the tension releasing device rotate at a driving speed which is faster comparing to the normal conveying speed to temporarily release the tension applied to the continuous sheet M. However, the load applied to the continuous sheet M can be reduced by also using the stretching roller 428 together.

That is, if the driving roller 427 which is the tension releasing device is simply made to rotate at a driving speed which is faster comparing to the normal conveying speed, the portion of the continuous sheet M that is located on the downstream side of the driving roller 427 in the conveying direction becomes loose and the tension applied to the continuous sheet M is temporarily released. On the other hand, the opposite happens on the upper stream side of the driving roller 427 in the conveying direction and greater tension is applied to the continuous sheet M which becomes a load to the continuous sheet M.

Therefore, the controller 80 controls the stretching roller 428 (stretching device) which is provided on the upper stream side of the driving roller 427 in the conveying direction so as to extend the continuous sheet M which is being conveyed in one direction (in the TN21 direction shown in FIG. 2) to make the continuous sheet have an extra portion, in the normal operation. When the conveying speed of the driving roller 427 is to be increased, the stretching roller 428 is made to move in the direction that allows to release the continuous sheet M which is being conveyed (in the NT21 direction shown in FIG. 2) to loosen the portion of the continuous sheet M on the upper stream side of the driving roller 427 in the conveying direction. In such way, the continuous sheet M can be prevented from having strong tension applied thereto and the load applied to the continuous sheet M can be reduced.

Here, in the above description of the embodiment, the voltage controller 90 carries out the so-called constant current controlling where the secondary transferring voltage is supplied at a predetermined constant current. However, a current controller can be provided instead of the voltage controller 90 to carry out the so-called constant voltage controlling where the secondary transferring current is supplied at a predetermined constant voltage.

In the case where the constant voltage controlling is carried out, a current supplier and a current measuring device is provided and the controller 80 makes the current supplier supply the secondary transferring current to rotate the driving roller 427 which is the tension releasing device at a driving speed which is faster than the normal conveying speed in order to temporarily release the tension applied to the continuous sheet M and to make the current measuring device measure the secondary transferring current as the first current (reference current). Then, the controller 80 returns the tension back to the original tension and makes the current measuring device measure the secondary transferring current as the second current (actual current). Thereafter, the controller 80 controls the nip width adjuster 429 to adjust the nip N so that the difference between the second current and the first current be within a predetermined range.

Further, in the above description of the embodiment, the controller 80 stores the correction value table in which correction values corresponding to differences are preset in the storage 72 and the controller 80 adjusts the pressing force applied to the secondary transfer roller 424 by using the correction value corresponding to the obtained difference. However, the pressing force applied to the secondary transfer roller 424 can be adjusted by the so-called feedback controlling.

For example, the controller 80 makes the voltage measuring device 92 measure the second voltage and the first voltage in a cyclic manner and continuously adjusts the width of the nip N while obtaining the adjusted widths of the nip width by the feedback controlling so that the difference between the second voltage and the first voltage be within a predetermined range.

In such case, the difference between the second voltage and the first voltage is gradually made to be within a predetermined range and thus, the width of the nip N can be adjusted more accurately.

Further, in the above description of the embodiment, the controller 80 determines whether to measure the first voltage on the basis of whether the continuous sheet M is conveyed 50*m*, for example. However, whether to measure the first voltage may be determined on the basis of elapsing of a predetermined time period or the like and not on the basis of the conveying distance of the continuous sheet M. Whether to measure the first voltage may also be determined on the basis of a detection result obtained by an image sensor or the like (for example, degradation in the image quality).

Further, in the above description of the embodiment, an image forming apparatus is described as an example. However, it is needless to say that the present invention is not limited to be applied to image forming apparatuses and can be applied to other apparatuses such as printing apparatuses.

Further, in the description of the embodiment, the intermediate transfer belt 421 is shown as an example of an image carrier and is described. However, a photoreceptive drum may be used as an image carrier.

Further, in the above description of the embodiment, the image forming apparatus 1 which includes image forming units corresponding to individual colors which are Y (yellow), M (magenta), C (cyan), K (black) and the like and which forms color images on the continuous sheet M is shown as an example. However, the present invention is not limited to be applied to such image forming apparatuses and can be applied to image forming apparatuses which form monotone images, for example.

Further, in the above description of the embodiment, the continuous sheet is shown as an example of a recording medium. However, the recording medium is not limited to sheets of paper and any material such as nonwoven fabric, plastic film, leather and the like can be used as the recording medium as long as it is in the form of sheet on which toner images can be formed and fixed.

Further, in the above description of the embodiment, an image forming apparatus in which images are formed by conveying a recording medium in the R2R (roll to roll) method is shown as an example. However, the present invention can have the same advantages even in the case where the recording medium is a long sheet of paper.

According to one aspect of a preferred embodiment of the present invention, there is provided an image forming apparatus in which tension is applied to a recording medium during secondary transferring, including an image carrier, a first rotating member which comes in contact with the image carrier, a second rotating member which sandwiches the image carrier with the first rotating member to from a nip, a tension releasing device which releases the tension, a voltage applier which applies a voltage between the first rotating member and the second rotating member at a predetermined constant current, a voltage measuring device which measures the voltage applied by the voltage applier, a nip width adjuster which adjusts a width of the nip, and a controller which controls the nip width adjuster so that a difference between a first voltage which is measured in a state where the tension releasing device is controlled to release the tension applied to the recording medium and a second voltage which is measured in a state where the tension is applied to the recording medium be within a predetermined range, the first voltage and the second voltage being measured by the voltage measuring device.

In the image forming apparatus, varying of the width of the secondary transferring nip can be controlled and the image quality can be improved even in the case where tension is applied to the continuous sheet during the secondary transferring.

The present patent application is based on Japanese Patent Application No 2015-236202 filed on Dec. 3, 2015 with the Japan Patent Office and the entire description of the present patent application is disclosed in Japanese Patent Application No 2015-236202.

What is claimed is:

1. An image forming apparatus in which tension is applied to a recording medium during secondary transferring, comprising:

an image carrier;

a first rotating member which comes in contact with the image carrier;

a second rotating member which sandwiches the image carrier with the first rotating member to form a nip;

a tension releasing device which releases the tension;

a voltage applier which applies a voltage between the first rotating member and the second rotating member at a predetermined constant current;

a voltage measuring device which measures the voltage applied by the voltage applier;

a nip width adjuster which adjusts a width of the nip; and a controller which controls the nip width adjuster so that a difference between a first voltage which is measured in a state where the tension releasing device is controlled to release the tension applied to the recording medium and a second voltage which is measured in a state where the tension is applied to the recording medium be within a predetermined range, the first voltage and the second voltage being measured by the voltage measuring device.

2. The image forming apparatus of claim 1, wherein in a case where the second voltage is greater than the first voltage, the controller controls the nip width adjuster so as to make the width of the nip be wider.

3. The image forming apparatus of claim 1, wherein the controller makes the nip width adjuster adjust the width of the nip on a basis of the first voltage and the second voltage which are measured before carrying out the secondary transferring.

4. The image forming apparatus of claim 1, wherein the controller makes the nip width adjuster adjust the width of the nip on a basis of the first voltage and the second voltage which are measured at a predetermined timing during the secondary transferring.

5. The image forming apparatus of claim 1, wherein the voltage measuring device repeatedly measures the first voltage and the second voltage, and the controller makes the nip width adjuster adjust the width of the nip continuously every time the first voltage and the second voltage are measured by the voltage measuring device.

6. The image forming apparatus of claim 1, wherein the first voltage and the second voltage are voltages in a case where a toner image is not formed on the image carrier.

7. An image forming system, comprising:

the image forming apparatus of claim 1;

a sheet feeding apparatus in which a roll of the recording medium is housed and which feeds the recording medium to the image forming apparatus; and a roll-up apparatus which rolls up the recording medium on which an image is formed by the image forming apparatus in a roll form.

8. An image forming apparatus in which tension is applied to a recording medium during secondary transferring, comprising:

an image carrier;

a first rotating member which comes in contact with the image carrier;

a second rotating member which sandwiches the image carrier with the first rotating member to form a nip;

a tension releasing device which releases the tension;

a current supplier which applies a current between the first rotating member and the second rotating member at a predetermined constant voltage;

a current measuring device which measures the current supplied by the current supplier;

a nip width adjuster which adjusts a width of the nip; and a controller which controls the nip width adjuster so that a difference between a first current which is measured in a state where the tension releasing device is controlled to release the tension applied to the recording medium and a second current which is measured in a state where the tension is applied to the recording medium be within a predetermined range, the first current and the second current being measured by the current measuring device.

9. The image forming apparatus of claim 8, wherein the controller makes the nip width adjuster adjust the width of the nip on a basis of the first current and the second current which are measured before carrying out the secondary transferring.

10. The image forming apparatus of claim 8, wherein the controller makes the nip width adjuster adjust the width of the nip on a basis of the first current and the second current which are measured at a predetermined timing during the secondary transferring.

11. The image forming apparatus of claim 8, wherein the current measuring device repeatedly measures the first current and the second current, and the controller makes the nip width adjuster adjust the width of the nip continuously every time the first current and the second current are measured by the current measuring device.

12. The image forming apparatus of claim 8, wherein the first current and the second current are currents in a case where a toner image is not formed on the image carrier.

13. The image forming apparatus of claim 1, wherein the nip width adjuster adjusts a pressing force applied to the second rotating member.

14. The image forming apparatus of claim 1, wherein the tension releasing device releases the tension by increasing a conveying speed of the recording medium before the secondary transferring.

15. The image forming apparatus of claim 14, wherein the tension releasing device includes a stretching device which extends the recording medium in a predetermined direction, and the tension releasing device moves the stretching device in a direction that allows to release the recording medium when the conveying speed of the recording medium is to be increased.

16. An image forming system, comprising:

the image forming apparatus of claim 8;

a sheet feeding apparatus in which a roll of the recording medium is housed and which feeds the recording medium to the image forming apparatus; and a roll-up apparatus which rolls up the recording medium on which an image is formed by the image forming apparatus in a roll form.

17. An image forming method in which tension is applied to a recording medium during secondary transferring, comprising:

first measuring a first voltage or a first current in a state where the tension is released;

second measuring a second voltage or a second current in a state where the tension is applied; and adjusting a width of a nip so that a difference between the first voltage and the second voltage or a difference between the first current and the second current be within a predetermined range, the nip being formed by two rotating members sandwiching an image carrier.

* * * * *